US006161361A

United States Patent [19]

Ehrenkrantz

[11] Patent Number: 6,161,361

[45] Date of Patent: Dec. 19, 2000

[54] COMPOSITE STRUCTURAL MEMBER AND METHOD OF FABRICATION THEREOF

[75] Inventor: Ezra Ehrenkrantz, Dobbs Ferry, N.Y.

[73] Assignee: New Jersey Institute of Technology, Newark, N.J.

[21] Appl. No.: 09/022,197

[22] Filed: Feb. 11, 1998

[51] Int. Cl.[7] ..... E04C 3/30

[52] U.S. Cl. ..... 52/731.9; 52/729.1; 52/729.5; 52/729.2; 52/733.2; 52/737.2

[58] Field of Search ..... 52/729.2, 729.5, 52/731.9, 729.1, 733.2, 737.2, 561, 562, 737.3, 309.16, 737.6, 736.2

[56] References Cited

U.S. PATENT DOCUMENTS

| | | | |
|---|---|---|---|
| Re. 34,022 | 8/1992 | Davis | 52/733.2 |
| 3,203,151 | 8/1965 | Bransford, Jr. | 52/733.2 |
| 3,358,848 | 12/1967 | Johnsson | 52/737.2 |
| 3,531,901 | 10/1970 | Will et al. . | |
| 5,519,978 | 5/1996 | Sucato et al. | 52/731.9 |
| 5,554,713 | 9/1996 | Freeland . | |
| 5,605,024 | 2/1997 | Sucato et al. | 52/733.2 |
| 5,609,006 | 3/1997 | Boyer . | |
| 5,875,604 | 3/1999 | Rudd | 52/731.8 |
| 5,930,968 | 8/1999 | Pullam | 52/481.1 |

OTHER PUBLICATIONS

Kosny et al., Thermal Breaking Systems for Metal Stud Walls–Can Metal Stud Walls Perform as Well as Wood Stud Walls? in ASHRAE Transactions:Symposia, 529.

*Primary Examiner*—Christopher T. Kent
*Assistant Examiner*—Dennis L. Dorsey
*Attorney, Agent, or Firm*—Klauber & Jackson

[57] ABSTRACT

In a preferred embodiment, a composite structural member having a pair of spaced apart longitudinally extending parallel flanges and a plurality of thermally insulative conductive web connectors intermittently disposed between the flanges, the web connectors having a pair of opposing ends, each end being attached to a respective flange, wherein at least two of the web connectors are longitudinally spaced apart from each other, thereby forming at least one open cavity defined by at least some portion of the flanges and the at least two web connectors, whereby the web connectors and the open cavity minimize thermal conductance between the flanges. The present invention includes a method of producing the composite structural member.

22 Claims, 13 Drawing Sheets

COMPOSITE STRUCTURAL MEMBER AND METHOD OF FABRICATION THEREOF

FIELD OF THE INVENTION

The present invention relates to structural members generally and, more particularly, but not by way of limitation, to a novel composite structural member and a method of fabrication thereof.

BACKGROUND OF THE INVENTION

The present invention concerns structural members such as studs, beams, joists, trusses, mounts, and supports, as used in frames, walls, doors, windows, and other building structures and substructures.

Wood has been used to a large extent in many types of structures. Metal has also been used, most significantly in large structures, for example, in frames for high-rise buildings.

However, wood has increased in price and quality structural lumber has decreased in availability. Metal, while plentiful, strong and relatively inexpensive, typically presents undesirable thermal characteristics. Nevertheless, steel studs intended for building construction purposes have been produced, and apparatus and processes for the construction of such steel studs are known. Steel studs are often used in commercial building interiors but external application of the steel studs is limited for various disadvantages, a major disadvantage being the aforementioned undesirable thermal characteristics. Steel studs have also been used in housing construction in a limited fashion because, for example, the thermal transfer through the steel stud requires the addition of a complex means of insulating such studs or walls, resulting in increased bracing costs, labor costs, length of time of construction, etc.

A principal object of the invention is to provide an improved structural member which offers the benefits of metal, and in particular, steel, while reducing the undesirable thermal characteristics thereof.

Another object is to provide an economic method of producing such structural members.

Yet another object is to provide a method of producing such structural members utilizing known devices and methods of producing steel studs.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a particular embodiment, a composite structural member and method of fabrication therefor.

In a preferred embodiment, a composite structural member comprising a pair of spaced apart longitudinally extending parallel flanges and a plurality of thermally insulative conductive web connectors intermittently disposed between the flanges, the web connectors having a pair of opposing ends, each end being attached to a respective flange, wherein at least two of the web connectors are longitudinally spaced apart from each other, thereby forming at least one open cavity defined by at least some portion of the flanges and the at least two web connectors, whereby the web connectors and the open cavity minimize thermal conductance between the flanges.

Each of the flanges preferably comprises a base portion and a pair of opposing arm portions depending away from the base portion, wherein the arm portions embrace the web connectors.

The inner surfaces of the base portion and the arm portions of each of the flanges substantially abut the ends of the web connectors.

The web connectors may further include a pair of end caps fixedly disposed on the opposing ends, wherein the end caps are adapted to engage the arm portions of the flanges.

Each of the arm portions may include an inwardly turned lip for preventing a corresponding flange from separating from the web connectors.

Each of the ends of the web connectors may be provided with a pair of opposing slots, each slot being adapted to receive a respective inwardly turned lip of a corresponding flange. The web connectors may comprise a pair of end caps, such that the inwardly turned lips of the flanges engage the outwardly projecting arm portions of the end caps.

Each of the flanges may be provided with a longitudinal recess on its outer periphery.

Each of the flanges may comprise an outwardly facing portion, a pair of opposed side portions depending from the outwardly facing portion, and a pair of inwardly facing portions depending from respective side portions and spaced apart by an opening, wherein the ends of the web connectors are disposed within the opening. Each of the inwardly facing portions may include a support lip for abutting the web connectors, wherein the support lip at least partially defines the opening. The support lip may project outward, or the support lip may extend toward the interior of the flange.

The flanges may generally form a hollow cross-section. The web connectors may abut the inner surface of the outwardly facing portion of the flanges.

The web connector may have a symmetric dumbbell shaped transverse cross-section. The web connector may also have substantially flat sides.

The web connectors may further comprise a narrow middle section disposed between the ends, and each of the ends of the web connectors may further comprise a wide end section and an inwardly sloping section disposed between the wide end and narrow middle sections, wherein the arm portions of the flanges are bent inwardly to embrace the inwardly sloping sections.

The flanges and the web connectors may be adapted to be snapped together.

In another aspect, in a preferred embodiment, the present invention relates to an automated method of producing a composite structural member from a plurality of thermally insulative conductive web connectors and first and second flanges, each flange being comprised of a base and a pair of opposing arms depending away from the base to form a generally U-shaped transverse cross-section. The method comprises the steps of aligning the first and second flanges in parallel relationship such that the open end of the flanges face each other, positioning the web connectors between the first and second flanges, and simultaneously moving the flanges toward the web connector so as to engage the flanges and the web connectors, thereby securely connecting the flanges and the web connectors to form the composite structural member.

In another embodiment, the present invention relates to a method of continuously producing a composite structural member from a first sheet of metal, a second sheet of metal, and a plurality of thermally insulative conductive web connectors. The method comprises: rolling at least a portion of the first sheet of metal into a first flange comprised of a base and a pair of opposing arms depending away from the base to form a generally U-shaped transverse cross-section; bringing the web connectors into contact with the first flange seriatim, wherein the web connectors are spaced apart along the first flange; rolling the arms of the first flange into engagement with the web connectors, thereby attaching the web connectors to the first flange; rolling at least a portion of the second sheet of metal into a second flange comprised of a base and a pair of opposing arms depending away from the base to form a generally U-shaped transverse cross-section; bringing into contact the second flange and the web connectors which are attached to the first flange; and rolling the arms of the second flange into engagement with the contacted web connectors; wherein the first and second sheets of metal are continuously rolled into the first and second flanges; whereby the web connectors are intermittently disposed between the flanges.

In yet another embodiment, the present invention relates to a method of continuously producing a composite structural member from a plurality of thermally insulative conductive web connectors and first and second flanges, each flange being comprised of a base and a pair of opposing arms depending away from the base to form a generally U-shaped transverse cross-section. The method comprises the following steps: bringing the web connectors into contact with the first flange seriatim, wherein the web connectors are longitudinally spaced apart along the first flange; bending the arms of the first flange into engagement with the web connectors, thereby attaching the web connectors to the first flange; bringing into contact the second flange and the web connectors which are attached to the first flange; and bending the arms of the second flange into engagement with the contacted web connectors, whereby the web connectors are intermittently disposed between the flanges. Preferable, the above-recited steps are performed sequentially and continuously.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which:

FIG. 3 shows a support lip which projects outwardly.

FIG. 4 shows a support lip which extends toward the interior of the flange.

FIG. 7 shows a flange having a base and a pair of opposing arms depending angularly away from the base.

FIG. 8 shows one end of the web connector being brought into contact with the flange of FIG. 7.

FIG. 9 shows the arms of the flange after being pressed or rolled onto or bent over the web connector.

FIG. 15 shows an intersection assembly comprised of four composite structural members.

FIG. 16 shows another T-connection between a first corner, a second corner and an outer wall.

FIG. 17 shows a corner assembly comprised of three composite structural members.

FIG. 18 shows an end assembly wherein a composite structural member provides the basis for connecting first, second and third walls.

FIG. 19 shows a composite structural member forming part of a door assembly.

FIG. 20 shows an end of a composite structural member of the present invention attached to another structure wherein the web connector nearest the end is spaced apart therefrom, resulting in an open-ended member.

FIG. 21 shows an end of a composite structural member of the present invention attached to another structure wherein the web connector nearest the end is substantially adjacent to the end of the member.

FIG. 22 shows the member of FIG. 21, wherein attachment of the member to the element is achieved by a bracket.

FIG. 24 shows the spacers or web connectors each having a pair of longitudinally oriented slots on each side of each end which are pressed into engagement with one of the flanges.

FIG. 25 shows the other flange brought into contact with the remaining free ends of the web connectors, wherein the second flange is also snapped into engagement with the web connectors.

DETAILED DESCRIPTION OF THE PREFERRED EMBODIMENTS

Figure 1:
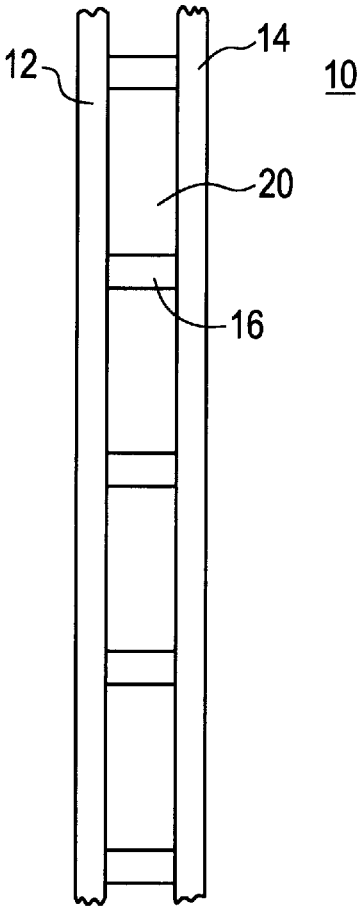
FIG. 1 schematically illustrates a composite structural member according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

1. COMPOSITE STRUCTURAL MEMBER

The present invention relates to a composite structural member comprising a pair of spaced apart longitudinally extending parallel flanges and a plurality of thermally insulative conductive web connectors intermittently disposed between the flanges, the web connectors having a pair of opposing ends, each end being attached to a respective flange. At least two of the web connectors are longitudinally spaced apart from each other, thereby forming at least one open cavity defined by at least some portion of the flanges and the at least two web connectors. Thus, the web connectors and the open cavity minimize thermal conductance between the flanges.

Preferably, each of the flanges further comprise a base portion and a pair of opposing arm portions depending angularly away from the base portion, wherein the arm portions embrace the web connectors.

The inner surfaces of the base portion and the arm portions of each of the flanges substantially may abut the ends of the web connectors.

In a preferred embodiment, the web connectors further comprise a pair of end caps fixedly disposed on the opposing ends, wherein the end caps are adapted to engage the arm portions of the flanges. The end caps may comprise a base portion and a pair of outwardly projecting arm portions depending therefrom, wherein the inwardly turned lips of the flanges engage the outwardly projecting arm portions of the end caps.

Each of the arm portions may further comprise an inwardly turned lip for preventing a corresponding flange from separating from the web connectors.

Furthermore, each of the ends of the web connectors may be provided with a pair of opposing slots, each slot being adapted to receive a respective inwardly turned lip of a corresponding flange.

Each of the flanges may also be provided with a longitudinal recess on its outer periphery.

In a particular embodiment, each of the flanges may include an outwardly facing portion, a pair of opposed side portions depending from the outwardly facing portion, and a pair of inwardly facing portions depending from respective side portions and spaced apart by an opening, wherein the ends of the web connectors are disposed within the opening. Thus, the flanges may generally form a hollow cross-section, and the web connectors may abut the inner surface of the outwardly facing portion of the flanges. Each of the inwardly facing portions may further comprise a support lip for abutting the web connectors, wherein the support lip at least partially defines the opening. The support lip may project outwardly, or may extend toward the interior of the flange.

The flange may be comprised of metal, preferably steel.

The web connector may be comprised of plastic. It a particularly preferred embodiment, the web connector is comprised of recycled plastic.

In a particular embodiment, the web connector has a symmetric dumbbell shaped transverse cross-section. The web connector may have substantially flat sides. Furthermore, the web connectors may comprise a narrow middle section disposed between the ends, and each of the ends of the web connectors may include a wide end section and an inwardly sloping section disposed between the wide end and narrow middle sections, wherein the arm portions of the flanges are bent inwardly to embrace the inwardly sloping sections.

In one embodiment, the flanges and the web connectors are adapted to be snapped together.

FIG. 1 schematically illustrates a composite structural member 10 according to the present invention.

The composite structural member 10 is comprised of a first flange 12, a second flange 14, and a plurality of thermally insulative conductive web connectors 16 intermittently disposed between the flanges 12. The flanges 12 are generally elongate and extend in a longitudinal direction. The flanges 12 are spaced apart and are aligned parallel to each other. Each web connector 16 has a pair of opposing ends 18, each end 18 being attached to a respective flange. At least two of the web connectors 16 are longitudinally spaced apart from each other, thereby forming at least one open cavity 20 defined by at least some portion of the flanges 12 and the at least two web connectors 16. Thus, the web connectors 16 and the open cavity 20 minimize thermal conductance between the flanges 12. Optionally, the open cavity 20 may be filled with insulative material, and in particular non-weight bearing or non-structural insulative material such as foam, fiberglass, or other insulation material commonly used. Furthermore, the open cavity 20 provides a passageway for fixtures, appliances, utility lines or conduits, such as electrical wires, piping, or communication lines.

Figure 2:
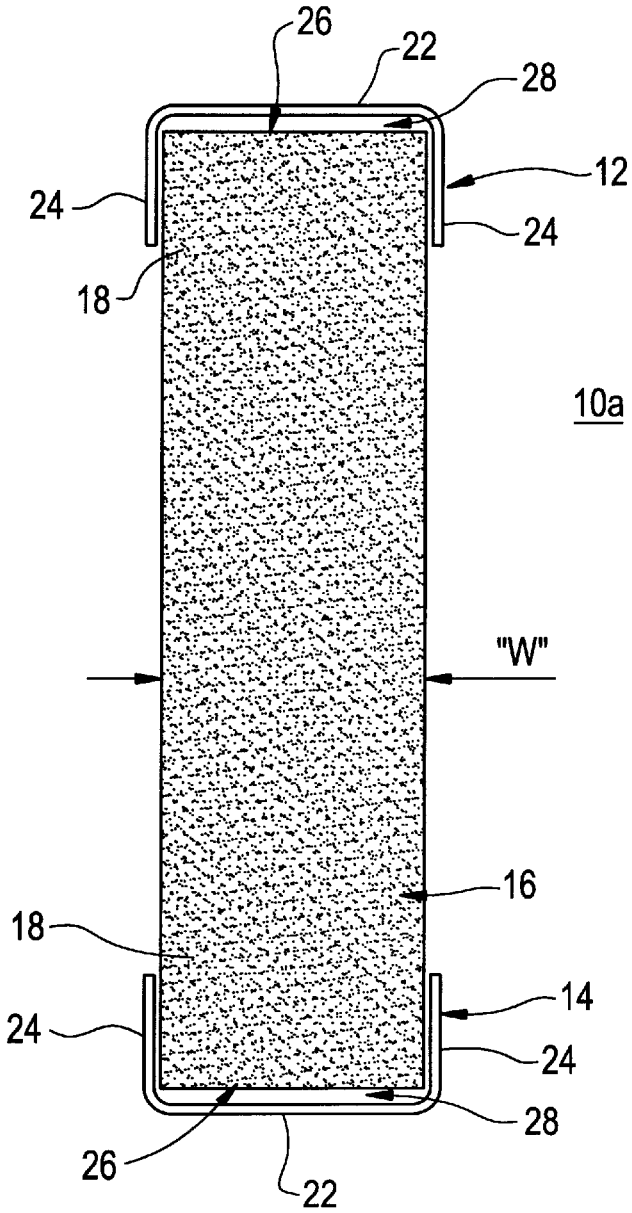
FIG. 2 illustrates a transverse cross-sectional cutaway view of a composite structural member according to one embodiment of the present invention.

FIG. 2 illustrates a transverse cross-sectional cutaway view of a composite structural member 10*a* according to one embodiment of the present invention. The flanges 12 are channel members, each channel member being comprised of a base portion 22 and a pair of opposing arm portions 24 depending angularly away from the base portion 22, wherein the arm portions 24 embrace the web connector or spacer 16. The arm portions 24 of each flange 12 are attached to the web connector 16, and preferably touch the web connector 16 so as to engage the web connector 16 therebetween. Optionally, the end tip 26 of the web connector 16 is spaced apart from the interior surface of the base portion 22 of the flange or channel member 12 so as to provide a gap 28 which is additionally beneficial to thermally separating the two flanges 12. The arm portions 24 may be crimped or rolled onto the web connector 16 to ensure a snug fit. Further optionally, the web connector 16 may be formed with a width "W" which is greater than the distance between the inner surfaces of the arm portions 24 when the channel member 12 is in an unloaded state, wherein the arm portions 24 must be spread apart to accept the web connector 16, and whereafter the arm portions 24 spring back against the web connector 16 for securement therebetween. Furthermore, an adhesive may be applied to the web connector 16 or the flanges 12 or both, so as to fixedly secure the web connector 16 between the flanges 12. Alternatively or in addition, a fastening means, such as a nail, screw, bolt, rivet or the like may join the web connectors 16 to the flanges 12.

In another embodiment, the inner surfaces of the base portion 22 and the arm portions 24 of each of the flanges 12 may substantially abut the ends 26 of the web connectors 16.

Preferably, each of the flanges 12 further comprise a base portion 22 and a pair of opposing arm portions 24 depending angularly away from the base portion 22, wherein the arm portions 24 embrace the web connectors 16.

Figure 3:
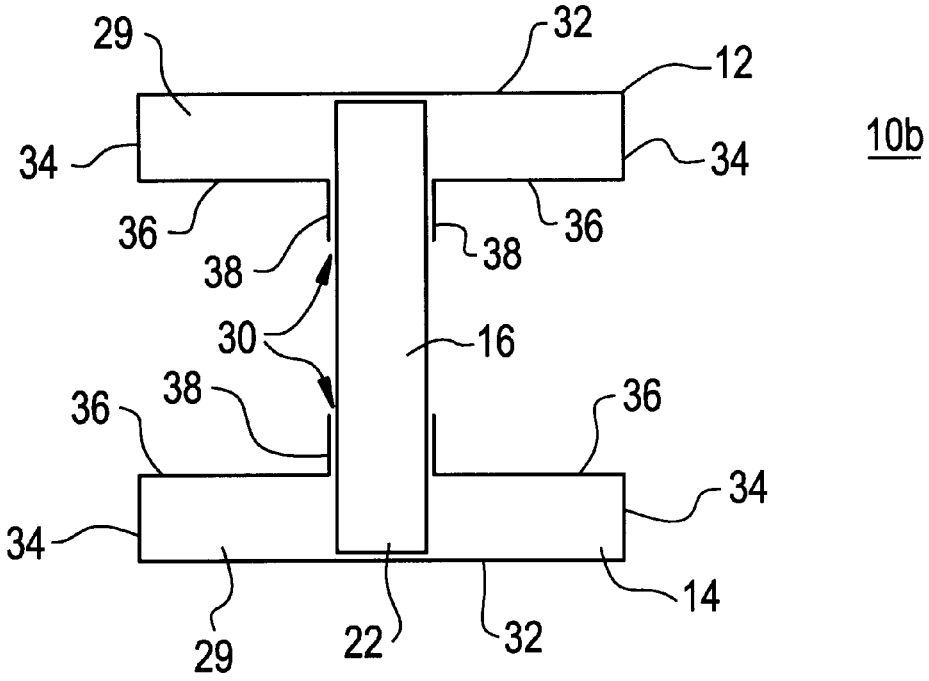
FIGS. 3 and 4 illustrate a transverse cross-sectional cutaway view of another particular embodiment of the present invention wherein each of the flanges is substantially hollow and has a longitudinal opening or slit.
Figure 4:
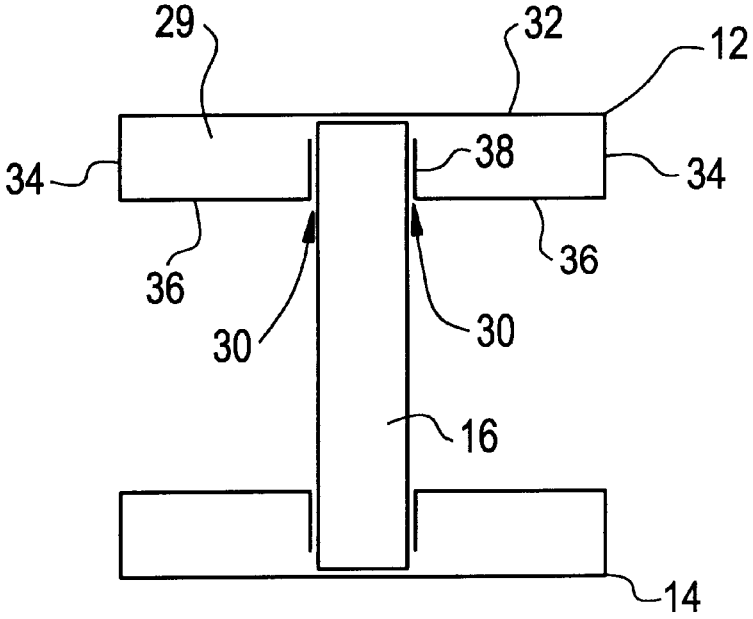

FIGS. 3 and 4 illustrate a transverse cross-sectional cutaway view of a composite structural member 10*b* another particular embodiment of the present invention wherein each of the flanges 12 defines an interior hollow cavity 29 and has a longitudinal opening or slit 30. The flange 12 includes an outwardly facing portion 32, a pair of opposed side portions 34 depending from the outwardly facing portion 32, and a, pair of inwardly facing portions 36 depending from respective side portions 34 and spaced apart by the opening 30, wherein the ends of the web connectors 16 are disposed within the opening 30. Thus, the flanges 12 may generally form a hollow cross-section, and the web connectors 16 abut the inner surface of the outwardly facing portion 32 of the flanges 12.

Furthermore, each of the inwardly facing portions 36 may further comprise a support lip 38 for abutting the web connectors, wherein the support lip 38 at least partially defines the opening 30.

FIG. 3 shows a support lip 38 which projects outwardly.

FIG. 4 shows a support lip 38 which extends toward the interior of its respective flange 12.

Figure 5:
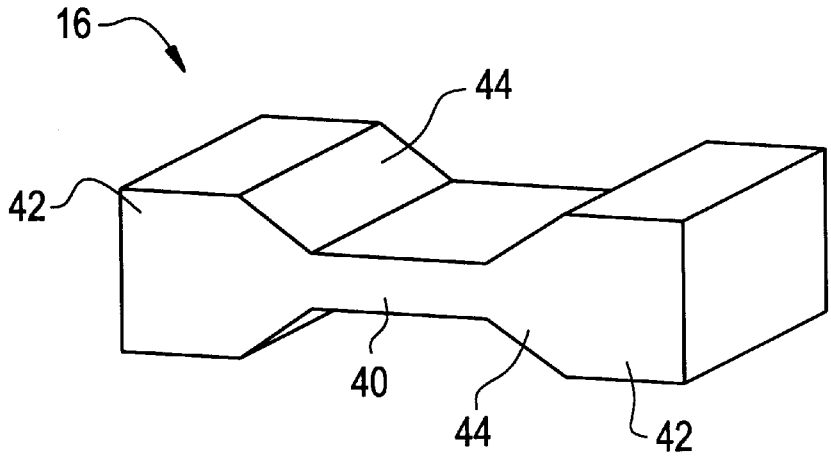
FIG. 5 shows another particular embodiment of a web connector or spacer according to the present invention wherein the web connector has a symmetric, dumbbell shaped, transverse cross-section.

FIG. 5 shows another particular embodiment of a web connector or spacer 16 according to the present invention. The web connector 16 has a symmetric, dumbbell shaped, transverse cross-section. The web connector 16 may have substantially flat sides. The web connector 16 has a narrow middle section 40 disposed between the ends and each end has wide end section 42 and an inwardly sloping section 44 disposed between the wide end 42 and narrow middle sections 40.

Figure 6:
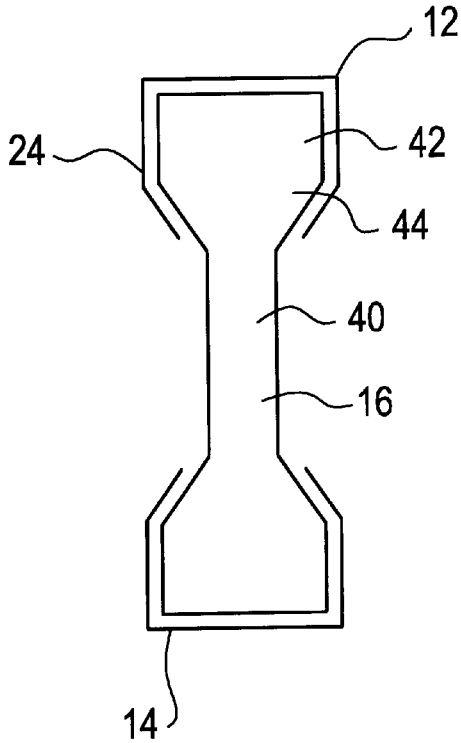
FIG. 6 shows a flange having arm portions which are bent inwardly to embrace the inwardly sloping sections and prevent separation of the flanges from the web connectors.

As shown in FIG. 6, the arm portions 24 of the flanges 12 may then be bent inwardly to embrace the inwardly sloping sections 44 and prevent separation of the flanges 12 from the web connectors 16.

Figure 7:
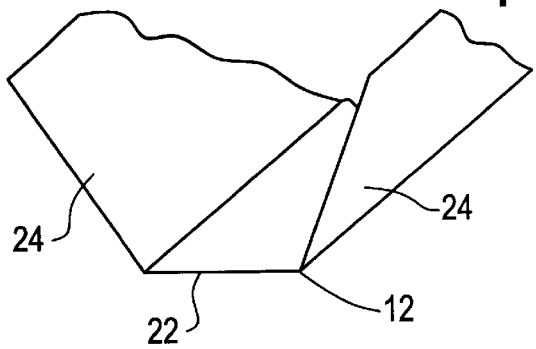
FIGS. 7–9 illustrate the method of attaching a flange to the web connector of FIG. 6.
Figure 8:
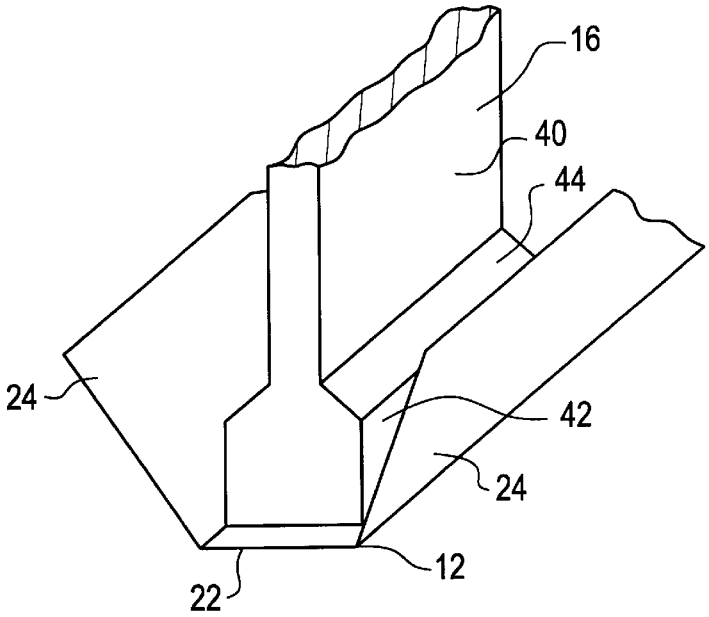
Figure 9:
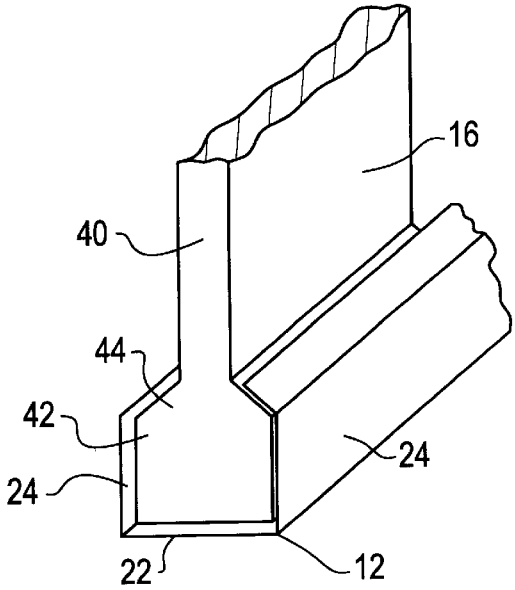

FIGS. 7–9 illustrate the method of attaching a flange 12 to the web connector 16 of FIG. 6.

FIG. 7 shows, for example, a flange 12 having a base 22 and a pair of opposing arms 24 depending angularly away from the base 22. The arms 24 are shown bent at an obtuse angle from the base 22, so as to present a generally U-shaped transverse cross-section.

FIG. 8 shows one end of the web connector 16 being brought into contact with the flange 12 of FIG. 7.

FIG. 9 shows the arms 24 of the flange 12 after being pressed or rolled onto or bent over the web connector 16. The arms 24 generally conform to the shape of the web connector 16, wherein the section of the arm 24 near its base 22 is shown disposed around the wide end section 42 of the web connector 16 at substantially a right angle with respect to the base 22, and wherein the distal end of the arm 24 is bent inward atop the sloping middle section 44 of the web connector 16 and toward the narrow middle section 40 of the web connector 16. Thus, the arms 24 of each flange 12 may be attached to the web connector 16, and the arms 24 preferably touch the web connector 16 so as to engage the web connector 16 therebetween.

Figure 10:
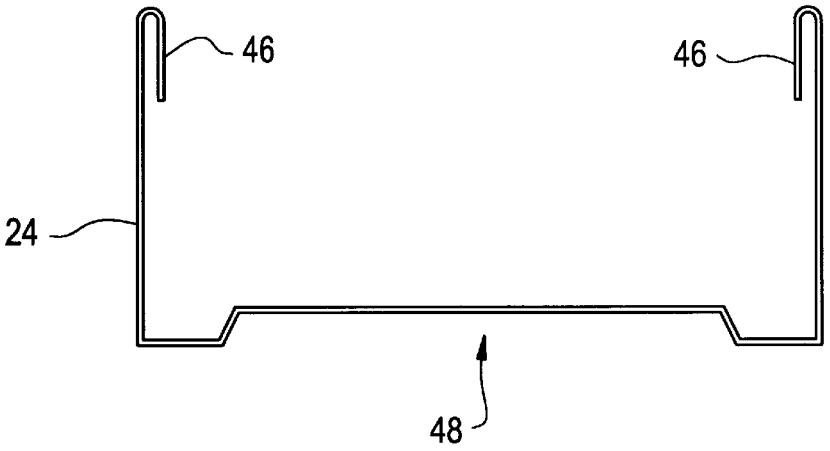
FIG. 10 shows a transverse cross-sectional cutaway view of yet another embodiment of the flange of the present invention wherein each of the arm portions of the flanges has an inwardly turned lip for preventing the flange from separating from the web connectors.

FIG. 10 shows a transverse cross-sectional cutaway view of yet another embodiment of the flange 12 of the present invention. Each of the arm portions of the flanges has an inwardly turned lip 46 for preventing the flange 12 from separating from the web connectors 16. The lip 46 is folded substantially back upon the inner surface of the remainder of the arm portions 24. Optionally, each of the flanges 12 may also be provided with a longitudinal recess 48 on its outer periphery. Depending upon a particular application, the longitudinal recess 48 may assist in reducing the transfer of heat through the outer ends of the structural member 10 by reducing the surface area in contact with an abutting surface, such as a sheet of drywall or a layer of insulative material.

Figure 11:
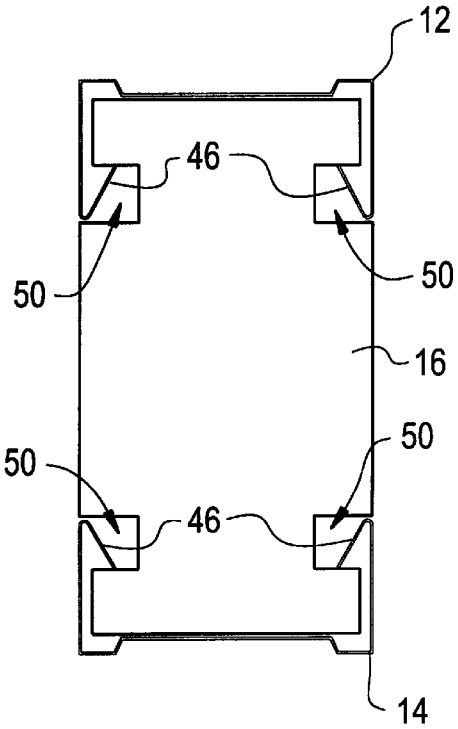
FIG. 11 shows the flange of FIG. 10 attached to a mating web connector wherein each of the ends of the web connectors is provided with a pair of opposing slots, each slot being adapted to receive a respective inwardly turned lip of a corresponding flange.

FIG. 11 shows the flange of FIG. 10 attached to a mating web connector 16. Each of the ends of the web connectors 16 is provided with a pair of opposing slots 50, each slot 50 being adapted to receive a respective inwardly turned lip 46 of a corresponding flange 12.

Figure 12:
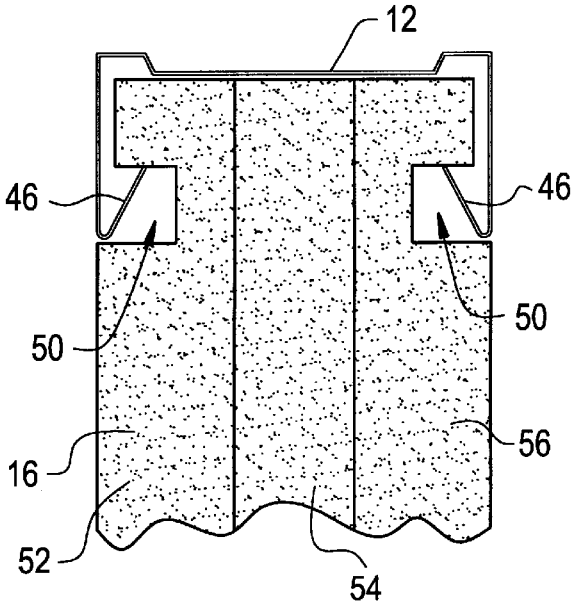
FIG. 12 shows a transverse cross-sectional cutaway view of still another embodiment of the present invention which is similar to the embodiment of FIG. 11 and which further comprises a web connector which is comprised of a plurality of layers of thermally insulative material.

FIG. 12 shows a transverse cross-sectional cutaway view of still another embodiment of the present invention which is similar to the embodiment of FIG. 11 and which further comprises a web connector 16 which is comprised of a plurality of layers 52, 54, 56 of thermally insulative material. In a particular embodiment, the layers are comprised of differing materials. For example, a middle layer 54 of gypsum may be sandwiched between two layers 52, 56 of recycled plastic. The gypsum has very favorable fire-resistant characteristics. The recycled plastic may be more easily formed to include slots and/or may better withstand the forces exerted by the inwardly turned lip 46 of a flange 12 during assembly and/or use of the structural member 10. Furthermore, the provision of a multi-layered web connector allows substitution or combinations of materials based upon a variety of design considerations, including cost, thereby affording great flexibility in applying the present invention to a variety of applications. The layers 52–56 may be gripped and held in place by the flanges 12, although preferably the layers are fastened together by adhesive or other connecting means.

Figure 13:
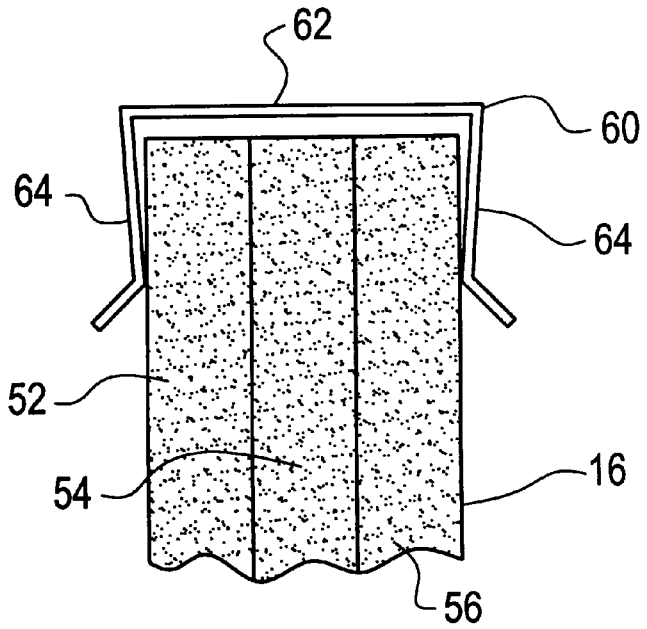
FIG. 13 shows a transverse cross-sectional cutaway view of a web connector of the present invention comprising an end cap fixedly disposed thereon.

As seen in FIG. 13, each end of the web connector 16 may further comprise an end cap 60 fixedly disposed thereon. The end cap 60 comprises a base portion 62 and a pair of outwardly projecting arm portions 64 depending therefrom. The end cap 60 may be attached to the main body of the web connector 16 by fastener means or adhesive means, or the end cap 60 may be adapted to be press fit or snap fit onto the main body of the web connector 16, for example, by a spring action provided by making the outwardly projecting arm portions 64 disposed inwardly or centrally, wherein the outwardly projecting arm portions 64 must be pried apart to allow the main body of the web connector 18 to be inserted therebetween, whereafter the arm portions 64 are allowed to snap back or spring back onto the main body, thereby firmly securing the main body therebetween.

Figure 14:
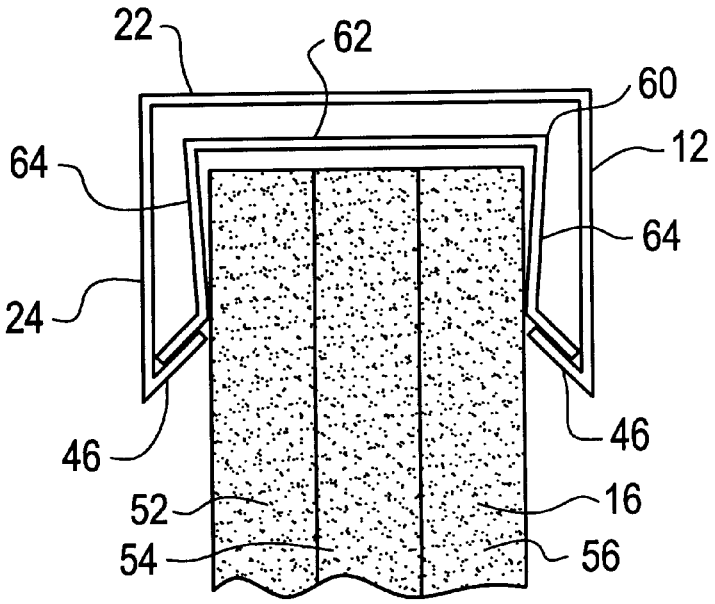
FIG. 14 shows the web connector of FIG. 13 adapted to engage the arm portions of a flange.

FIG. 14 shows the web connector 16 of FIG. 13 adapted to engage the arm portions 24 of the flanges 12. The flanges 12 and end caps 60 may be matingly constructed wherein the inwardly turned lips 46 of the flanges 12 engage the outwardly projecting arm portions 64 of the end caps 60 so as to allow the web connectors 16 and flanges 12 to be snapped together.

FIGS. 15–22 illustrate various embodiments of the present invention as employed in a variety of ways.

Figure 15:
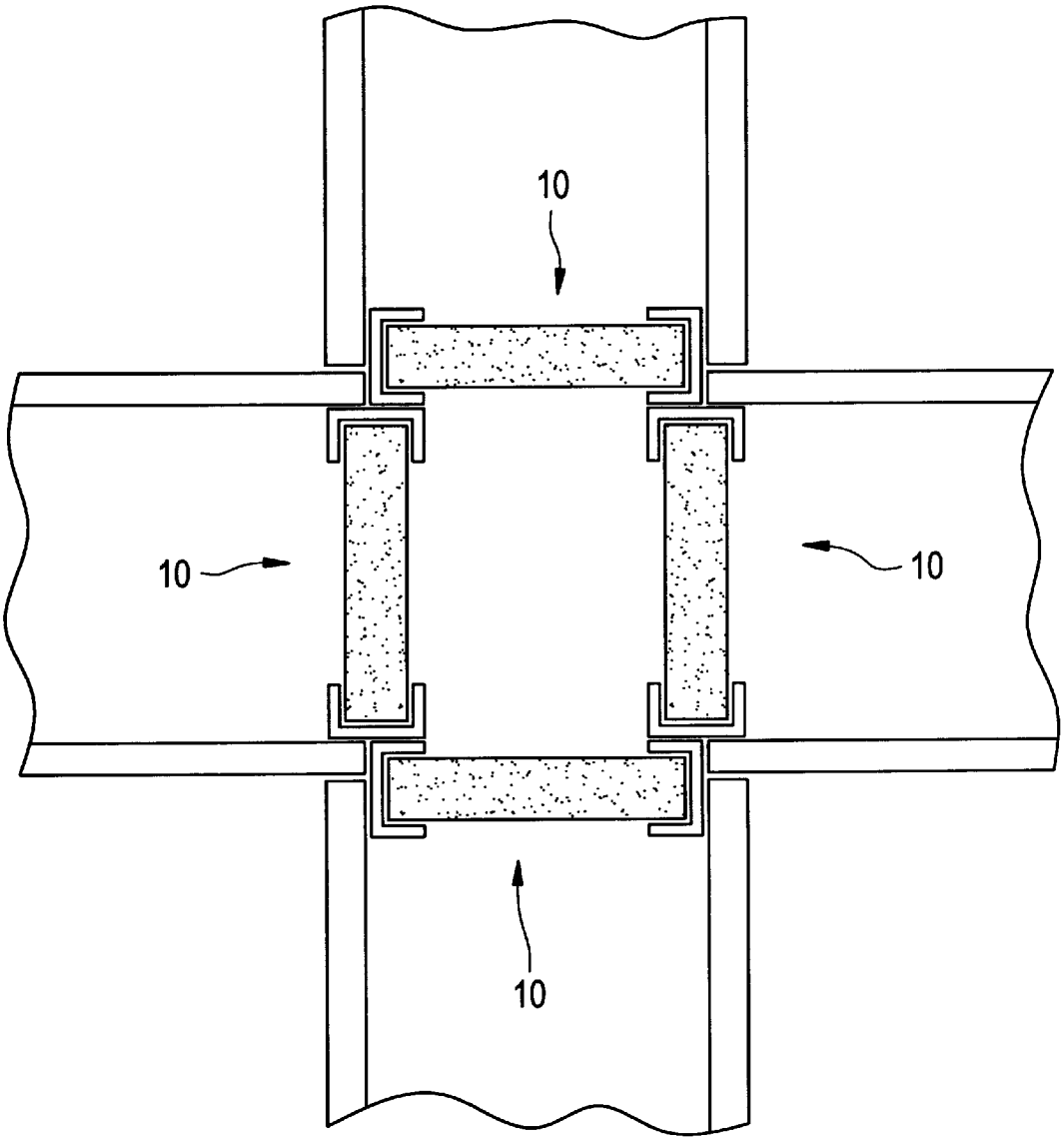
FIGS. 15–22 illustrate various embodiments of the present invention in a variety of applications.

FIG. 15 shows a construction comprised of four composite structural members 10 according to the present invention employed in an intersection joint, wherein four comers are supported by, and thermally isolated by, the four member 10.

Figure 16:
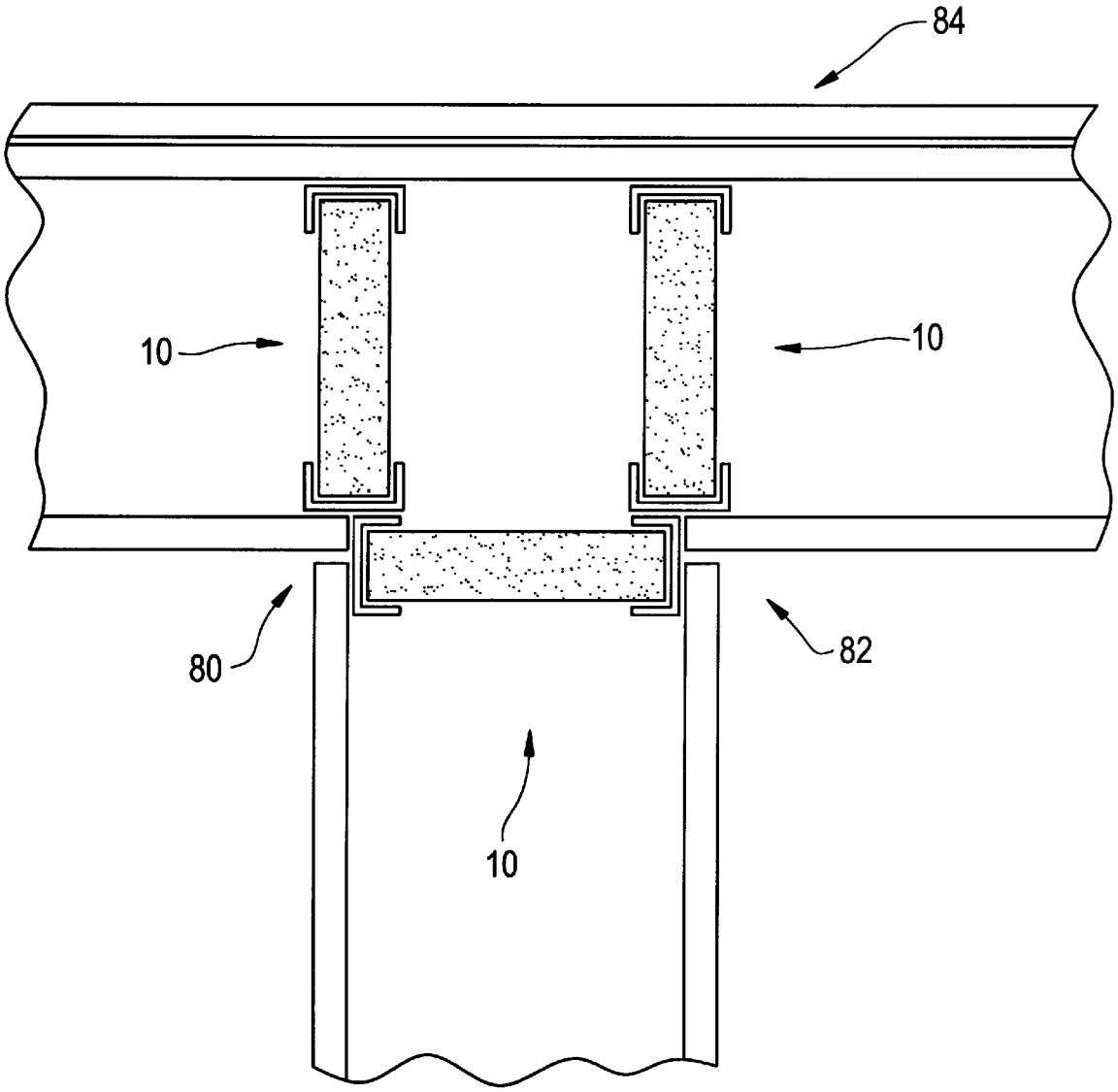

FIG. 16 shows a T-connection between a first corner 80, a second corner 82 and an outer wall 84. A first composite structural member 10 connects the first and second corners 80, 82 together. A second composite structural member 10 connects the first corner 80 and the outer wall 84, and a third composite structural member 10 connects the second corner 82 and the outer wall 84.

Figure 17:
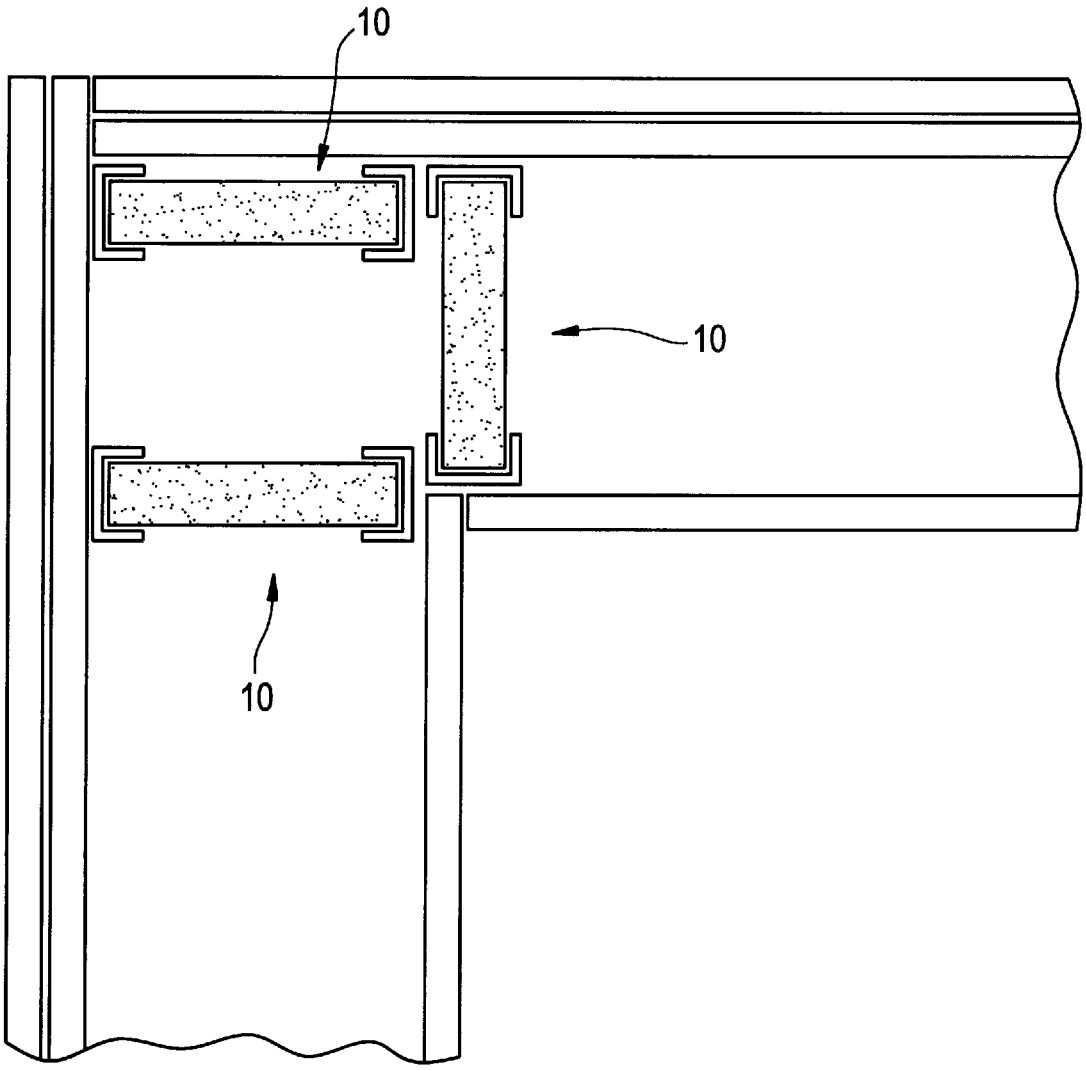

FIG. 17 shows a corner assembly comprised of three composite structural members 10.

Figure 18:
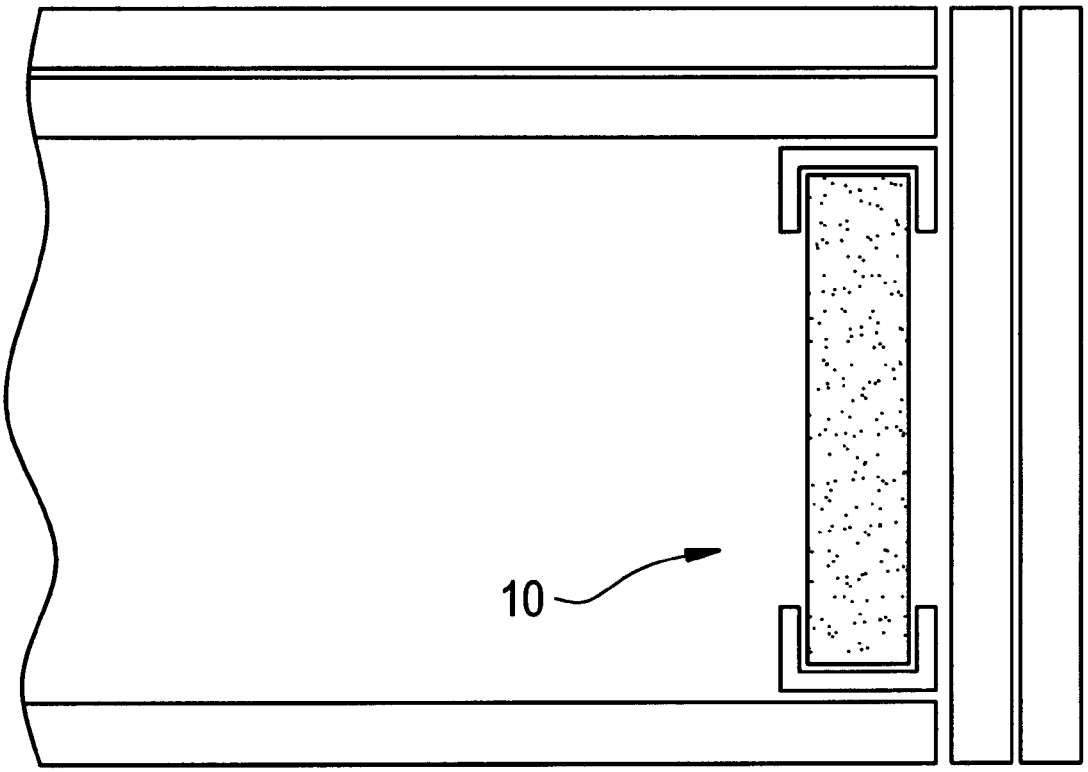

FIG. 18 shows an end assembly wherein a composite structural member 10 provides the basis for connecting first, second and third walls.

Figure 19:
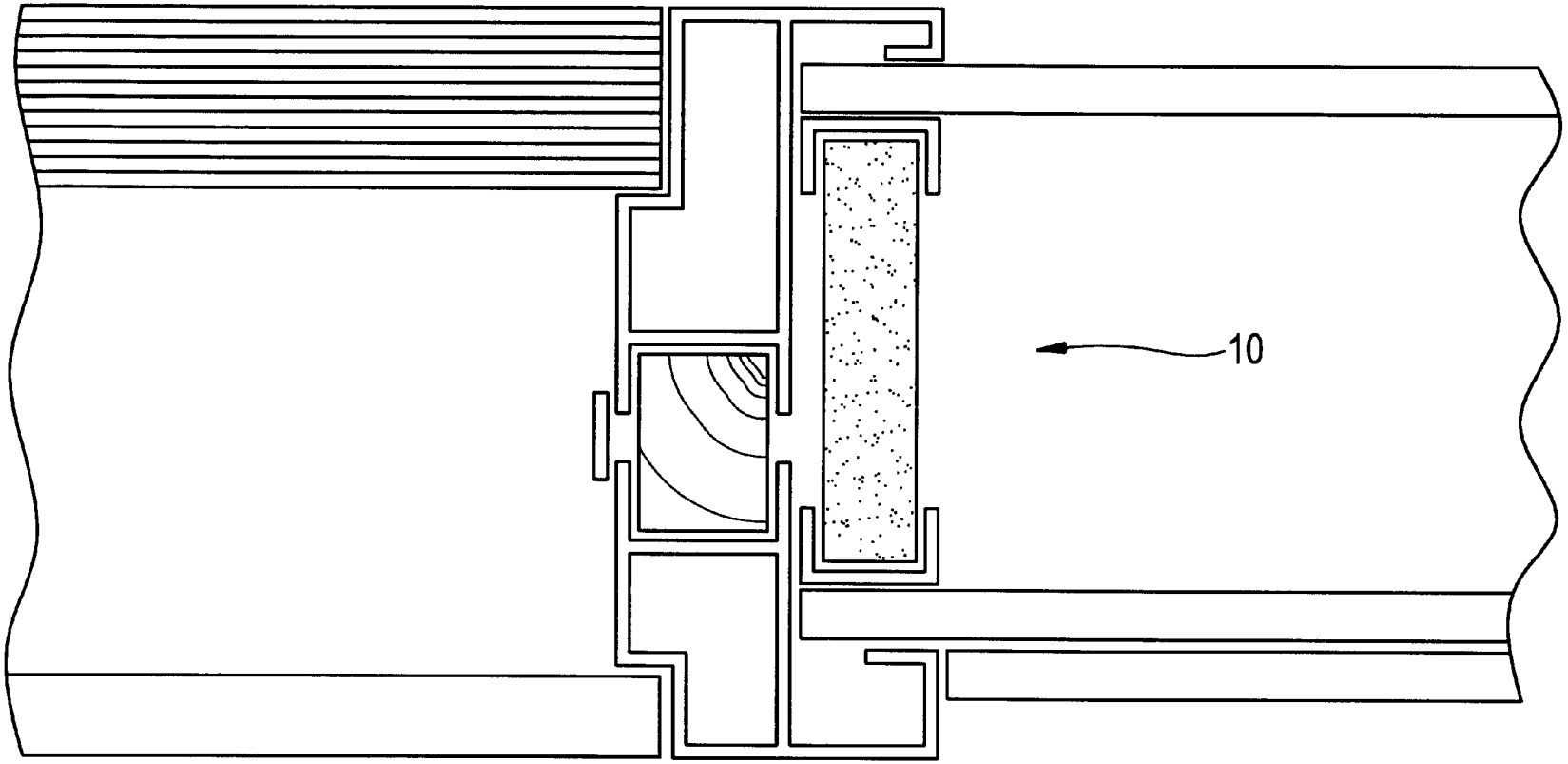

FIG. 19 shows a composite structural member 10 forming part of a door assembly.

Preferably, the flanges are comprised of metal, most preferably steel.

The web connector may be comprised of plastic or gypsum. In a particularly preferred embodiment, the web connector is comprised of recycled plastic.

In another embodiment, the web connector is made from wood.

Figure 20:
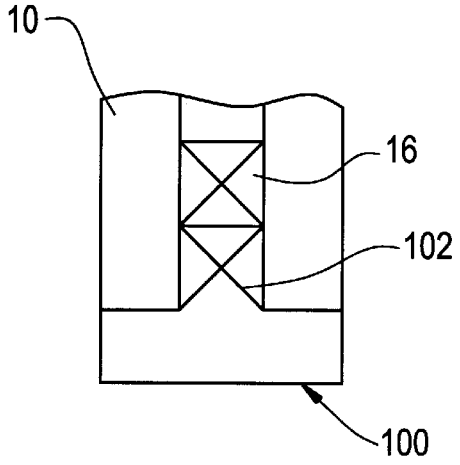

FIG. 20 shows an end of a composite structural member 10 of the present invention wherein the web connector 16 nearest the end is spaced apart therefrom, resulting in an open-ended member. The open-ended member 10 is shown vertically disposed over a another element 100 having a raised ridge or raised knob 102, such as a window sill, as shown in dashed lines. Attachment of the member 10 to the element 100 is achieved by driving a fastener through the flange 12 into the raised ridge 102 of the element 100, or through the web connector 16 into the raised ridge 102.

Figure 21:
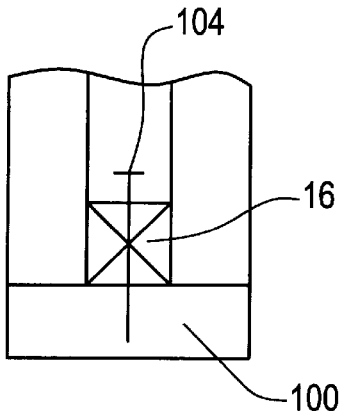

FIG. 21 is similar to FIG. 20, except that the web connector substantially abuts the end of the stud. Attachment of the member 10 to the element 100 is achieved by driving a fastener through the web connector 16 into the element 100. For example, if the web connector 16 is made from wood, a nail 104 may be driven therethrough.

Figure 22:
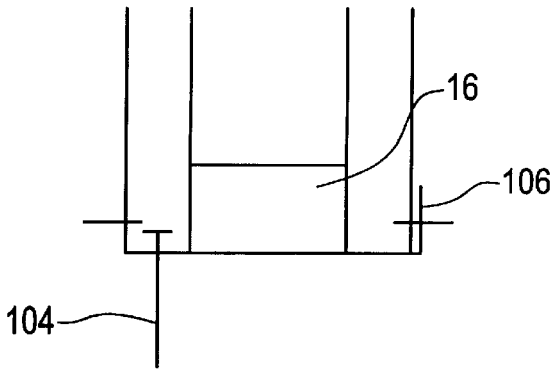

FIG. 22 is similar to FIGS. 20 and 21, except that attachment of the member 10 to the element 100 is achieved by a bracket 106 which is fastened or pre-fastened to a supporting structure or surface, e.g. by nails 104, after which the stud is placed in the bracket 106 and attached thereto by an appropriate attachment means.

It should be understood that the composite structural member of the present invention may be formed to serve as building stud, joist, beam, support, mount, sill, or other structural member, whether load bearing or non-load bearing. For example, a thermal stud according to the present invention may be formed in accordance with the size of a 2×4 or a 2×6. The present invention may be used in residential and non-residential applications, and is particularly well suited for wall construction.

In one particular embodiment, the composite thermal stud according to the present invention comprises a plurality of web connectors, wherein at least two web connectors are comprised of different materials. For example, it may be desirable to include a web connector made of wood and disposed near the end of a stud, while other web connectors in the same stud are made from a plastic material. Such a configuration may be desirable, for example, for purposes of ease of further attachment to another structural member, such as a window sill or door frame, as methods of attachment to wood may be more readily available, or cheaper, or easier than other attachment means.

A frame assembly comprised of a plurality of composite structural members of the present invention provides an essentially non-thermally conductive structural assembly. The open cavity provided between each web connector of each structural member may be partially or fully filled with additional insulation material. The assembly may thus provide insulative properties derived from insulation as well as interconnected or isolated air spaces, as desired.

Thus, the present invention may provide a thermal stud which incorporates the desirable features of structural metals such as steel while also essentially providing a thermal break which is not achievable by metal alone. Of course, the thermal stud of the present invention may be compatible with and used in conjunction with known steel studs including steel stud interior construction. Moreover, the thermal stud of the present invention can provide for enhanced thermal properties and for passage of services. As a result, the present invention can provide significant cost/performance advantages and energy efficiencies which were not previously known. Furthermore, the present invention can provide a means to reduce the amount of wood and wood products used in the construction industry.

Moreover, the present invention can provide a fire-rated configuration, such as a wall configuration, which is not achievable by construction with wood or other non-fire resistant materials alone. For example, if the web connector of the present invention is at least partially made of gypsum, in the event of a fire, the gypsum will tend to keep cool by losing its water of hydration, thereby absorbing heat and cooling the flanges. By way of further example, a wall assembly comprised of a plurality of composite structural members according to the present invention may improve the fire-rating of a sheetrock wall.

One particular embodiment of the present invention in the form of a 2.5"×6" composite structural stud, comprised of two steel 2.5" flanges of 20 gauge steel was tested to the point of buckling failure. For a comparison, a 2×4 wood stud, a commercially available all-steel 6" C-stud of 18 gauge steel, and a single 2.5", 20 gauge steel flange (which formed part of the composite structural member) were tested for buckling failure as well. The weight per linear foot in the commercially available all-steel C-stud was equal to the linear weight of the steel in the composite structural member, wherein the 20 gauge steel used in the composite structural member was concentrated at the ends of the web connectors, while the 18 gauge steel of the C-stud was distributed throughout its ends and web. Averaged results of the testing showed that the wood stud buckled at 2795 pounds, the single steel flange at 2926 pounds, the steel C-stud at 6774 pounds, and the composite structural member at 8797 pounds. Thus, the composite structural member of the present invention provided a stronger structure than the all-steel member for a given weight per linear foot, because of its advantageous distribution of the steel. Furthermore, in this example, the present invention was able to obtain such results with a thinner gauge steel (20 gauge vs. 18 gauge) which has significant advantages in production of the composite structural members, including faster production speeds and lower costs.

In another embodiment of the composite structural member according to the present invention (not shown), this embodiment comprises one or more web connectors having chamfered ends which may serve to self-center the web connectors when inserted into the flanges.

2. METHOD OF PRODUCING THE COMPOSITE STRUCTURAL MEMBER

A key feature of producing the composite stud according to the present invention is continuous production thereof, which is essential to keeping down the costs of producing the studs, and therefore the ultimate cost of the stud itself. Typically, the assemblage of previously manufactured parts increases such costs, thereby reducing the attractiveness of the final product from a cost standpoint.

Therefore, in a particularly preferred embodiment, the present invention entails continuous production of the composite thermal members, as further described below. Furthermore, the composite thermal members are preferably produced by utilizing existing equipment or processes.

For example, known steel studs, i.e. C-studs formed entirely from steel, are currently produced by providing a coil of steel (e.g. 18-gauge), slicing the coil of steel to a desired width, forming the steel by rolling into a C-shaped cross-section, and cutting sections of the rolled steel to desired lengths on the production line. Typically, the steel studs are not intended to be cut to length at the construction site, for example, by hacksaws or the like, but rather are custom fit to size at the factory. Up to this point, this stage of the production process of the known steel studs is referred to herein as the "forming" stage. The equipment and processes related to this forming stage are known to those skilled in the art. Generally, the forming stage comprises a relatively rapid process and operates at a higher speed which corresponds to the speed at which a ribbon of steel is formed.

Thereafter in the production process, in what is referred to herein as the "packaging" stage, the cut sections of C-studs emerge from the production line, wherein the studs may be paired, the open ends turned toward one another and the studs nested for subsequent binding, stacking and packaging. The packaged pairs, or groups of pairs, are then stored or shipped. Thus, equipment and processes already exists for grabbing and turning pairs of C-studs into a particular desired relationship with respect to each other. Generally, the packaging stage operates at a slower pace than the forming stage as the material handling aspects typically involve more intensive or more time consuming manipulations of the studs.

The present invention contemplates a method of producing composite structural members which, in one aspect, corresponds to formation of the structural member in a forming stage, and in another aspect, corresponds to the formation of the structural member in the packaging stage.

A. FORMING METHOD

The composite structural members of the present invention may be produced as the C-channel or U-channels are being formed.

Figure 23:
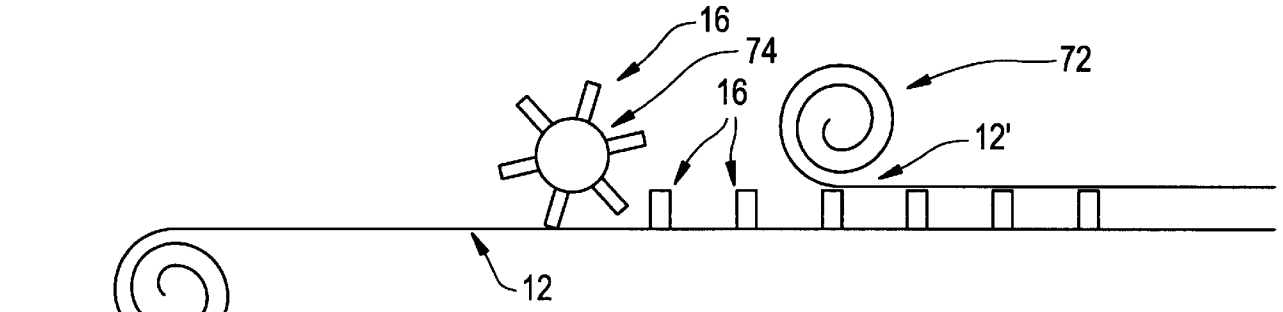
FIG. 23 schematically illustrates a method of continuously producing a composite structural member according to the present invention.

FIG. 23 schematically illustrates at least part of a method of continuously producing a composite structural member 10 according to the present invention from a first roll of metal 70, a second roll of metal 72, and a plurality of thermally insulative conductive web connectors 16 supplied by a connector placement device 74. At least a portion of the first sheet of metal 70 is rolled or formed into a first flange 12 comprised of a base and a pair of opposing arms depending away from the base to form a generally U-shaped transverse cross-section. Individual web connectors 16 are placed into contact with the first flange 12 seriatim by the connector placement device 74, wherein the web connectors 16 are spaced apart along the first flange 12. The web connectors 16 are fixedly attached to the first flange 12 by bending or rolling the arms of the first flange into engagement with the web connectors 16, thereby attaching the web connectors 16 to the first flange 12. At least a portion of the second sheet of metal 72 is rolled or formed into a second flange 12' comprised of a base and a pair of opposing arms depending away from the base to form a generally U-shaped transverse cross-section. The second flange 12' and the web connectors 16 are brought into contact, and the second flange 12' and web connectors 16 are fixedly attached to each other by bending or rolling the arms of the second flange 12' into engagement with the web connectors 16. The first and second sheets of metal 70, 72 are continuously unrolled from respective rolled supplies of metal and continuously formed into the first and second flanges 12, 12'. As a result, the web connectors 16 are intermittently disposed between the flanges 12, 12' in the final assembly of the composite structural member.

Figure 24:
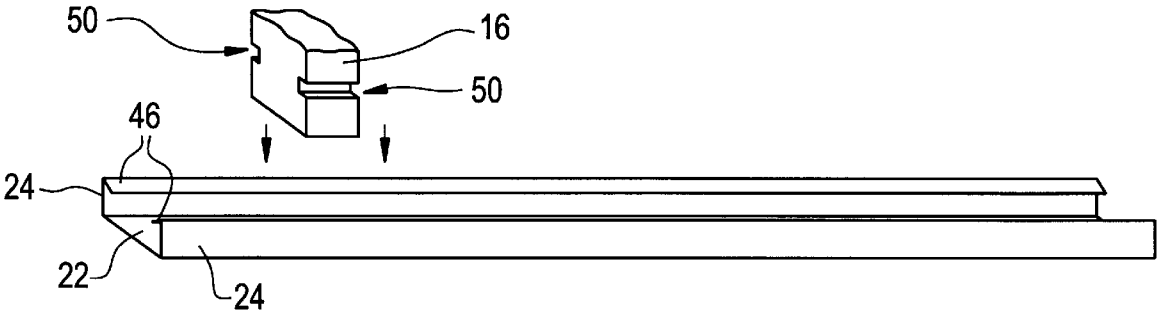
FIGS. 24 and 25 illustrate another embodiment for producing a composite structural member according to the present invention.
Figure 25:
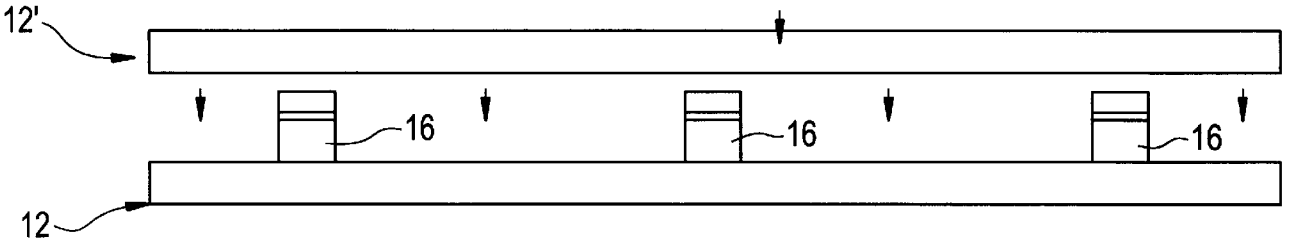

FIGS. 24 and 25 illustrate another embodiment of a method for producing a composite structural member according to the present invention. First and second flanges 12, 12' are pre-formed to include a base portion 22 and a pair of opposing arm portions 24 depending angularly away from the base portion 22, the arm portion 24 including inwardly turned lips 46.

In another aspect, the present invention relates to a method of continuously producing a composite structural member from a first sheet of metal, a second sheet of metal, and a plurality of thermally insulative conductive web connectors. The method comprises the following: rolling at least a portion of the first sheet of metal into a first flange comprised of a base and a pair of opposing arms depending away from the base to form a generally U-shaped transverse cross-section; bringing the web connectors into contact with the first flange seriatim, wherein the web connectors are spaced apart along the first flange; rolling the arms of the first flange into engagement with the web connectors, thereby attaching the web connectors to the first flange; rolling at least a portion of the second sheet of metal into a second flange comprised of a base and a pair of opposing arms depending away from the base to form a generally U-shaped transverse cross-section; bringing into contact the second flange and the web connectors which are attached to the first flange; and rolling the arms of the second flange into engagement with the contacted web connectors. The first and second sheets of metal are continuously rolled into the first and second flanges, whereby the web connectors are intermittently disposed between the flanges. The rolling may comprise a series of progressively increased roll angles. Thus, the web connectors are placed into contact with the first flange as the first flange moves or rolls past a connector placement device, while the first flange and connectors roll parallel to a rolling second flange "downstream" of the connector placement device.

In another embodiment, the present invention relates to a method of continuously producing a composite structural member from a plurality of thermally insulative conductive web connectors and first and second flanges, each flange being comprised of a base and a pair of opposing arms depending away from the base to form a generally U-shaped transverse cross-section. The method comprises the following steps: (a) bringing the web connectors into contact with the first flange seriatim, wherein the web connectors are longitudinally spaced apart along the first flange; (b) bending the arms of the first flange into engagement with the web connectors, thereby attaching the web connectors to the first flange; (c) bringing into contact the second flange and the web connectors which are attached to the first flange; and (d) bending the arms of the second flange into engagement with the contacted web connectors. Thus, the web connectors are intermittently disposed between the flanges. These steps are preferably performed sequentially and continuously.

In yet another embodiment, the present invention concerns a method of producing a composite structural member having first and second flanges and a plurality of thermally insulative conductive web connectors intermittently disposed between the flanges. The method comprises: (a) rolling a portion of a first sheet of metal into a portion of the first flange comprised of a base and a pair of opposing arms depending away from the base to form a generally U-shaped transverse cross-section; (b) bringing the web connector and the portion of the first flange into contact; (c) rolling the arms of the first flange into abutment with one end of the web connector; (d) rolling a portion of a second sheet of metal into a portion of the second flange comprised of a base and a pair of opposing arms depending away from the base to form a generally U-shaped transverse cross-section; (e) bringing the web connector and the portion of the second flange into contact; and (f) rolling the arm portions of the second flange into abutment with the other end of the web connector. Steps a–f are repeated, and the first and second sheets of metal are continuously rolled into the first and second flanges while the web connectors are brought into contact with the first flange seriatim, whereby the web connectors are longitudinally spaced apart from each other.

In another particular embodiment, the first and second flanges may be punched or pressed so as to provide dimples or indentations in the flange material and which press against and further retaining the web connectors therebetween.

In still another embodiment, two flanges are aligned and spaced apart, and each web connector is sequentially slid between the two flanges. Such process requires adequate tolerance control, and is believed to be limited in its speed of production.

B. PACKAGING METHOD

The composite structural members of the present invention may be produced after the C-channels or U-channels have been formed.

In a particularly preferred embodiment of the present invention, a pair of flanges are formed and cut to size, then manipulated such that the open ends of the generally U-shaped or C-shaped cross-sections face each other, with one or more web connectors being held in position therebetween. The flanges are then preferably simultaneously moved toward the web connector(s) and pushed thereon to engage the web connector(s). The web connectors may be secured between the flanges by friction fit, or locking arm, or adhesive, or fastening means, or by another connection means, or some combination thereof, to produce a composite stud. Thus, the composite thermal member of the present invention may be produced in a continuous manner at rapid speed, whereby production costs thereof would be minimized.

Figure 26:
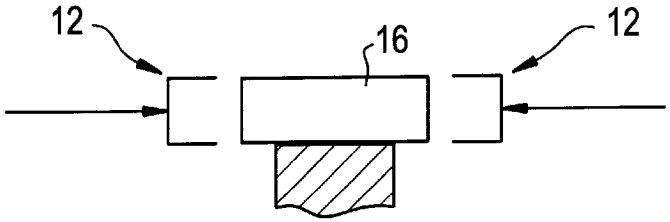
FIG. 26 illustrates part of a preferred method of fabricating a composite structural member according to the present invention.

FIG. 26 illustrates the simultaneous pressing of two flange members onto a web connector positioned therebetween according to a preferred method of fabricating a composite thermal structural member according to the present invention.

Thus, in a preferred embodiment, the present invention relates to an automated method of producing a composite structural member from a plurality of thermally insulative conductive web connectors and first and second flanges, each flange being comprised of a base and a pair of opposing arms depending away from the base to form a generally U-shaped transverse cross-section. The method comprises the steps of aligning the first and second flanges in parallel relationship such that the open end of the flanges face each other, positioning the web connectors between the first and second flanges, and simultaneously moving the flanges toward the web connector so as to engage the flanges and the web connectors, thereby securely connecting the flanges and the web connectors to form the composite structural member.

As seen in the embodiment of FIG. 24, the spacers or web connectors 16, each having a pair of longitudinally oriented slots 50 on each side of each end, are pressed into engagement with one of the flanges 12, wherein the web connector 16 snaps into place by engaging the inwardly turned lips 46 of the flange 12 with the slots 50. The web connectors 16 may be inserted one at a time in a spaced relationship, or more than one spaced apart web connectors 16 may be inserted at once.

As shown in FIG. 25, the other flange 12' is then brought into contact with the remaining free ends of the web connectors 16, wherein the second flange is also snapped into engagement with the web connectors.

In summary, in producing the composite member according to the present invention, one or more web connectors may be introduced between, and connect, a pair of generally U-shaped or C-shaped studs, either as the studs are being formed, or after the studs have been fully formed, as, for example, would be found in the packaging stage of currently existing machinery.

Additionally, in either one of the forming method or the packaging method, the arms of each flange may be spread apart by a spreader as each web connector is brought into contact therewith, thereby allowing placement of the web connector between the arms of the flange, after which the arms are released to fold in upon the web connector, thereby firmly securing the connector therebetween. Such manipulation becomes less preferable at higher production speeds and for higher strength flanges.

Thus, a key feature of the present invention is the ability to rapidly and cheaply produce composite structural elements having superior structural and thermal properties.

The composite structural member of the present invention is preferably fabricated to withstand certain design loads, such as compressive loads, buckling loads, lateral loads, and the like. For example, the integrity or strength of the connection between the flanges and the web connector(s) should be sufficient to resist wind loads or lateral loads such that both flanges are effectively engaged in providing resistance to the wind loads.

That is, in at least one preferred embodiment, the connection between the flanges is sufficient to allow both the "inner" as well as the "outer" flange (e.g. when oriented toward the interior and the exterior of a building structure) to share in providing support against a wind load. For example, if the connection between the flanges is not sufficient to adequately accommodate wind loading, a disproportionately high amount of the wind loading may be absorbed by, say, the "exterior" flange, thereby leading to an early buckling failure of the member. Furthermore, wind loading of the member may translate into an undesirable "point loading" of the "exterior" flange while the "interior" flange experiences less of a loading.

Therefore, the production of a particular embodiment of the present invention may include a consideration of providing an adequate connection between the flanges so as to withstand certain wind loads or lateral loads. Parameters relevant to providing an adequate connection can include: (1) the number of web connectors or spacers in a given section of the composite structural member or stud; (2) the distance between web connectors or spacers; (3) the size of the web connectors or spacers; (4) the material from which the web connectors or spacers fare made; and/or (5) the type or quality of the connection between the web connectors or spacers and the flanges.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A composite structural member comprising:

a pair of spaced apart longitudinally extending parallel flanges; and a plurality of web connectors comprised of a thermally insulative material intermittently disposed between said flanges, said web connectors having a pair of opposing ends, each end being attached to a respective flange;

wherein at least two of said web connectors are longitudinally spaced apart from each other, thereby forming at least one open cavity defined by at least some portion of said flanges and said at least two web connectors;

wherein each of said flanges further comprises a base portion and a pair of arm portions oppositely disposed, said arm portions defining inwardly facing surfaces distal to said base portion, wherein said inwardly facing surfaces of said flanges sandwich therebetween said thermally insulative material at areas of said opposite lateral sides of said web connectors to engage said web connectors between said inwardly facing surfaces at the distal end to firmly hold said web connectors to said parallel flanges, said inwardly facing surfaces adapted to conform to said opposite lateral sides substantially over the entire contact areas and enhance the structural performance of the composite structural member.

2. The composite structural member according to claim 1 wherein the inner surfaces of said base portion and said arm portions of each of said flanges substantially abut said ends of said web connectors.

3. The composite structural member according to claim 1 wherein said web connectors further comprise a pair of end caps fixedly disposed on said opposing ends, wherein said end caps are adapted to engage said arm portions of said flanges.

4. The composite structural member according to claim 1 wherein each of said arm portions further comprise an inwardly turned lip for preventing a corresponding flange from separating from said web connectors.

5. The composite structural member according to claim 4 wherein each of said ends of said web connectors is provided with a pair of opposing slots, each slot being adapted to receive a respective inwardly turned lip of a corresponding flange.

6. The composite structural member according to claim 1 wherein each of said flanges is provided with a longitudinal recess on its outer periphery.

7. The composite structural member according to claim 1 wherein said web connector has a symmetric dumbbell shaped transverse cross-section.

8. The composite structural member according to claim 7 wherein said web connector further comprises substantially flat sides.

9. The composite structural member according to claim 1 wherein said web connectors further comprise a narrow middle section disposed between said ends.

10. The composite structural member according to claim 9 wherein each of said ends of said web connectors further comprises a wide end section and an inwardly sloping section disposed between said wide end and narrow middle sections; wherein said arm portions of said flanges are bent inwardly to embrace said inwardly sloping sections.

11. The composite structural member according to claim 1 wherein said flanges and said web connectors are adapted to be snapped together.

12. The composite structural member according to claim 1 wherein said flange is comprised of metal.

13. The composite structural member according to claim 1 wherein said flange is comprised of steel.

14. The composite structural member according to claim 1 wherein said web connector is comprised of plastic.

15. The composite structural member according to claim 1 wherein said web connector is comprised of recycled plastic.

16. A composite structural member comprising:

a pair of spaced apart longitudinally extending parallel flanges; and a plurality of thermally insulative conductive web connectors intermittently disposed between said flanges, said web connectors having a pair of opposing ends, each end being attached to a respective flange;

wherein at least two of said web connectors are longitudinally spaced apart from each other, thereby forming at least one open cavity defined by at least some portion of said flanges and said at least two web connectors;

whereby said web connectors and said open cavity minimize thermal conductance between said flanges:

wherein each of said flanges further comprise a base portion and a pair of opposing arm portions depending away from said base portion, wherein said arm portions embrace said web connectors;

wherein each of said arm portions further comprise an inwardly turned lip for preventing a corresponding flange from separating from said web connectors;

wherein said web connectors further comprise a pair of end caps fixedly disposed on said opposing ends, wherein said end caps comprise a base portion and a pair of outwardly projecting arm portions depending therefrom, wherein said inwardly turned lips of said flanges engage said outwardly projecting arm portions of said end caps.

17. A composite structural member comprising:

a pair of spaced apart longitudinally extending parallel flanges; and a plurality of thermally insulative conductive web connectors intermittently disposed between said flanges, said web connectors having a pair of opposing ends, each end being attached to a respective flange;

wherein at least two of said web connectors are longitudinally spaced apart from each other, thereby forming at least one open cavity defined by at least some portion of said flanges and said at least two web connectors;

whereby said web connectors and said open cavity minimize thermal conductance between said flanges;

wherein each of said flanges further comprise an outwardly facing portion, a pair of opposed side portions depending from said outwardly facing portion, and a pair of inwardly facing portions depending from respective side portions and spaced apart by an opening, wherein said ends of said web connectors are disposed within said opening.

18. The composite structural member according to claim 17 wherein said flanges generally form a hollow cross-section.

19. The composite structural member according to claim 18 wherein said web connectors abut the inner surface of said outwardly facing portion of said flanges.

20. The composite structural member according to claim 17 wherein each of said inwardly facing portions further comprises a support lip for abutting said web connectors, wherein said support lip at least partially defines said opening.

21. The composite structural member according to claim 20 wherein said support lip projects outward.

22. The composite structural member according to claim 20 wherein said support lip extends toward the interior of said flange.

* * * * *